US010856593B2

(12) United States Patent
De La Nuez et al.

(10) Patent No.: US 10,856,593 B2
(45) Date of Patent: Dec. 8, 2020

(54) TIE KNOT SYSTEM AND DEVICE

(71) Applicants: Jeffrey R. De La Nuez, Melbourne, FL (US); Nelson R. De La Nuez, Orlando, FL (US)

(72) Inventors: Jeffrey R. De La Nuez, Melbourne, FL (US); Nelson R. De La Nuez, Orlando, FL (US)

( * ) Notice: Subject to any disclaimer, the term of this patent is extended or adjusted under 35 U.S.C. 154(b) by 153 days.

(21) Appl. No.: 16/136,050

(22) Filed: Sep. 19, 2018

(65) Prior Publication Data

US 2019/0364998 A1 Dec. 5, 2019

Related U.S. Application Data

(63) Continuation-in-part of application No. 29/650,016, filed on Jun. 4, 2018, now abandoned.

(51) Int. Cl.

| | |
|---|---|
| ***A41D 25/02*** | (2006.01) |
| ***A41D 25/00*** | (2006.01) |
| ***A41D 25/10*** | (2006.01) |
| ***A41D 25/08*** | (2006.01) |
| *A44B 6/00* | (2006.01) |

(52) U.S. Cl.

CPC ..... *A41D 25/025* (2013.01); *A41D 25/003* (2013.01); *A41D 25/08* (2013.01); *A41D 25/10* (2013.01); *A44B 6/00* (2013.01)

(58) Field of Classification Search

CPC ..... A41D 25/025; A41D 25/08; A41D 25/10; A41D 25/003; A44B 6/00

See application file for complete search history.

(56) References Cited

U.S. PATENT DOCUMENTS

| | | | | |
|---|---|---|---|---|
| 2,024,943 A | | 12/1935 | Vlix | |
| 2,142,322 A | | 1/1939 | Martin | |
| 2,479,463 A | | 8/1949 | Billingsley | |
| 2,529,957 A | * | 11/1950 | Newman | A41D 25/02 2/153 |
| 2,605,473 A | * | 8/1952 | Halsey | A41D 25/022 2/153 |
| 2,714,719 A | * | 8/1955 | Peake | A41D 25/12 2/153 |
| 3,665,519 A | | 5/1972 | Calhoun, Sr. | |
| 3,745,614 A | * | 7/1973 | Tsang | A41D 25/022 2/148 |

(Continued)

OTHER PUBLICATIONS

Kickstarter, The tie redefined, GC Windsor, May 25, 2016, Kickstarter project, https://www.kickstarter.com/projects/444692190/the-tie-redefined-a-fresh-view-of-the-old-standard/description.

*Primary Examiner* — Khaled Annis

(74) *Attorney, Agent, or Firm* — Olav M. Underdal; IDP Patent Services

(57) ABSTRACT

A tie knot system, including a necktie and a tie knot member with an interior and first and second upper apertures and a lower aperture, including an inner knot member positioned in the interior, such that a narrow tail of the necktie protrudes through the lower aperture and out of the first upper aperture and loops back via the second upper aperture and out of the lower aperture. The inner knot member can be made of a resilient material, have elongated openings, and can be folded and assembled from a tie knot sheet, including a bridge portion and left and right elongated portions.

18 Claims, 12 Drawing Sheets

(56) References Cited

U.S. PATENT DOCUMENTS

| | | | | |
|---|---|---|---|---|
| 3,964,105 | A * | 6/1976 | Gideon | A41D 25/022 24/49.1 |
| 3,999,222 | A | 12/1976 | Walborn | |
| 4,000,523 | A | 1/1977 | Woods | |
| 4,573,219 | A | 3/1986 | Hooten | |
| 4,977,624 | A | 12/1990 | Safford | |
| 5,493,731 | A | 2/1996 | Amnott | |
| 5,774,893 | A | 7/1998 | Torres | |
| 6,094,746 | A * | 8/2000 | Miller | A41D 25/10 2/138 |
| 6,205,586 | B1 | 3/2001 | Jenkins et al. | |
| 6,691,319 | B1 | 2/2004 | Simon | |
| 6,920,642 | B2 | 7/2005 | Dickens | |
| 7,716,750 | B2 | 5/2010 | Sato | |
| 8,713,713 | B2 | 5/2014 | Yan | |
| 9,095,180 | B1 | 8/2015 | Lovett | |
| 2002/0095713 | A1 | 7/2002 | Bonano et al. | |
| 2005/0120461 | A1* | 6/2005 | Dickens | A41D 25/022 2/144 |
| 2005/0204450 | A1* | 9/2005 | Dayan | A41D 25/02 2/148 |
| 2006/0143781 | A1* | 7/2006 | Sato | A41D 25/003 2/144 |
| 2009/0260128 | A1 | 10/2009 | Marzano | |
| 2010/0050318 | A1* | 3/2010 | Johnston | A41D 25/005 2/148 |
| 2011/0302692 | A1 | 12/2011 | Hanspiker | |
| 2014/0352029 | A1 | 12/2014 | Jones | |
| 2019/0029343 | A1* | 1/2019 | Samra | A41D 25/08 |

* cited by examiner

Tie Knot System

Tie Knot Member

Tie Knot Member

Inner Knot Member

Necktie

TIE KNOT SYSTEM AND DEVICE

CROSS-REFERENCE TO RELATED APPLICATIONS

This application is a continuation-in-part of U.S. Design Application No. 29/650,016, filed Jun. 4, 2018; which is hereby incorporated herein by reference in its entirety.

FIELD OF THE INVENTION

The present invention relates generally to the field of neckties, and more particularly to methods and systems for devices that simulate a tie knot.

BACKGROUND OF THE INVENTION

Neckties remain a popular fashion accessory. In order to make neckties more accessible and easier to use various necktie simulators have been developed and made available in the marketplace.

However, such necktie simulators suffer from various disadvantages. Particularly, they can be difficult to manufacture, they often may not hold a tie well, and it may be difficult to insert the tie through the necktie simulator. Also, they may not be designed to work well with neckties of conventional design, length, and proportions.

As such, considering the foregoing, it may be appreciated that there continues to be a need for novel and improved devices and methods for simulated tie knots.

SUMMARY OF THE INVENTION

The foregoing needs are met, to a great extent, by the present invention, wherein in aspects of this invention, enhancements are provided to the existing model of simulated tie knots.

In an aspect, a tie knot system can include:

a) a necktie; and b) a tie knot member;

wherein the tie knot member has first and second upper apertures and a lower aperture, whereby the tie knot member can receive the necktie, such that a narrow tail of the necktie protrudes through the lower aperture and out of the first upper aperture and loops back via the second upper aperture and out of the lower aperture.

In a related aspect, as the tie knot system can further include:

an inner knot member, which is positioned in the interior of the tie knot member;

wherein the inner knot member has first and second upper openings and a lower opening, whereby the inner knot member can receive the necktie, such that a narrow tail of the necktie protrudes through the lower opening and out of the first upper opening and loops back via the second upper opening and out of the lower opening.

In another related aspect, the inner knot member can be folded and assembled/connected from a tie knot sheet.

In a further related aspect, the tie knot sheet can be configured with a left-right symmetrical shape, such that the tie knot sheet can include:

a) a bridge portion, of which an upper edge can be shaped as a double-arch; and b) left/first and right/second elongated portions, wherein lower portions of the left/first and right/second elongated portions can be connected via the bridge portion, such that the left/first and right/second elongated portions can be upward and outward pointing;

wherein the elongated portions can be curved inward, such that outer ends can be connected to a rear side of the upper part of the bridge portion; and wherein lower inner ends of the elongated portions can be folded in to connect together.

In a related aspect, the inner knot member and the tie knot sheet can be made of a resilient material, such as rubber or leather, such that when the inner knot member is deformed by external pressure it will bounce back to its original shape once the pressure is removed.

In a further related aspect, the first and second upper openings and the lower opening of the inner knot member can be configured to be elongated in a right-to-left direction, when in a resting configuration, such that when external inward pressure is applied, the inner knot member is deformed, such that the first and second upper openings and the lower opening become less elongated in right-to-left direction, such that heights of the openings are increased, whereby it is easier to insert the necktie through the openings.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

Figure 1:
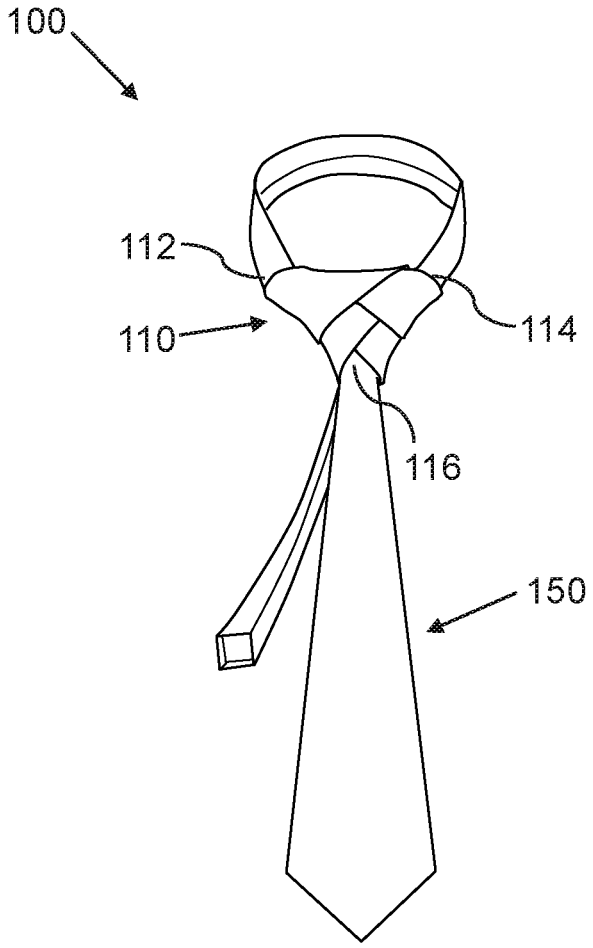
FIG. 1 is a perspective view of a tie knot system, according to an embodiment of the invention.
Figure 2A:
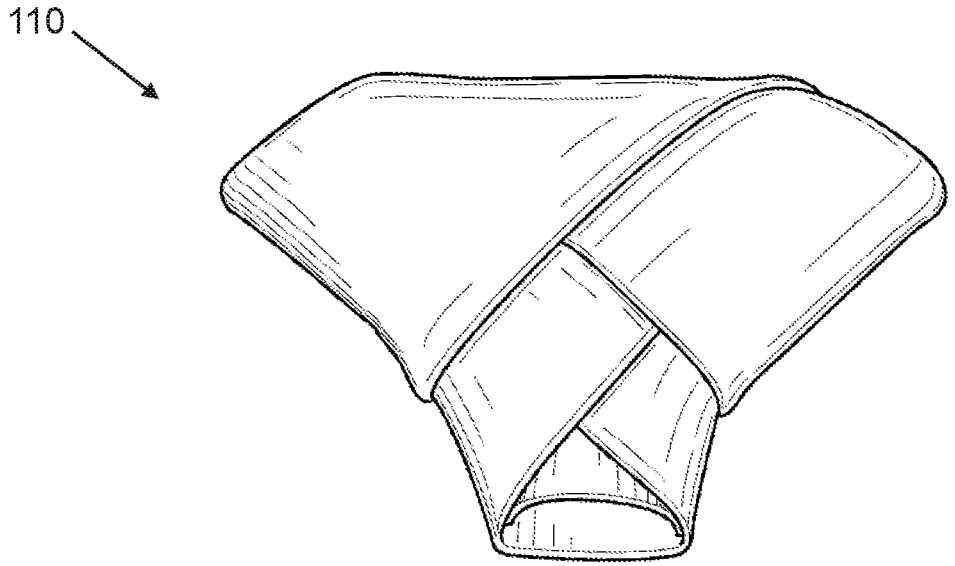
FIG. 2A is a front view of a tie knot member, according to an embodiment of the invention.
Figure 2B:
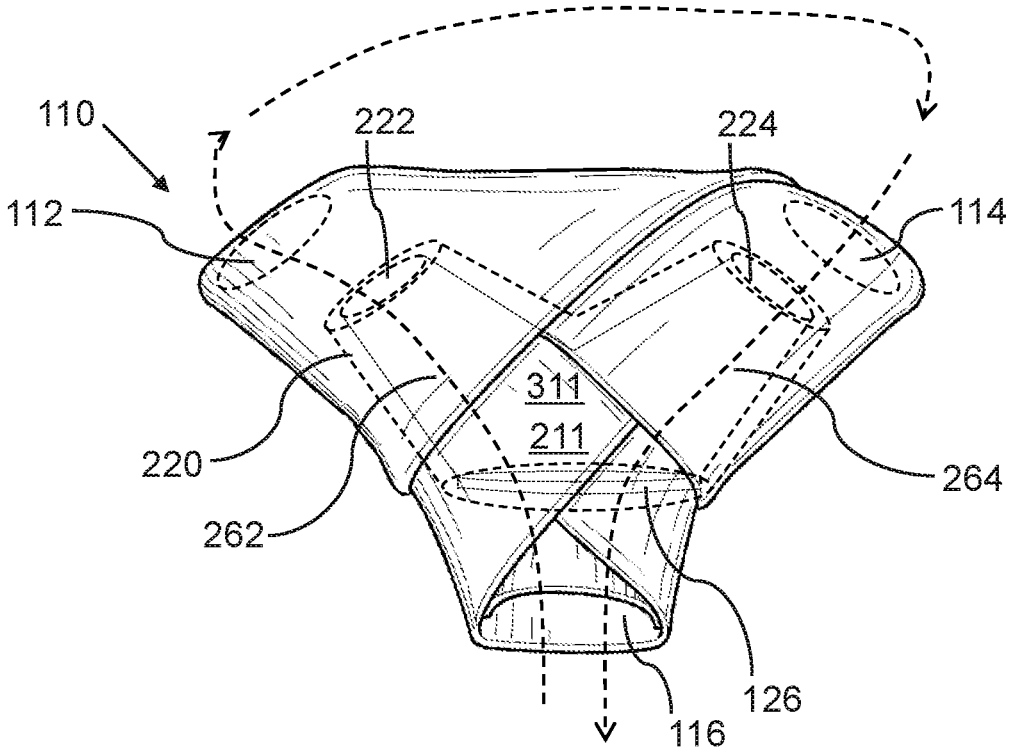
FIG. 2B is a front view of a tie knot member, according to an embodiment of the invention.
Figure 2C:
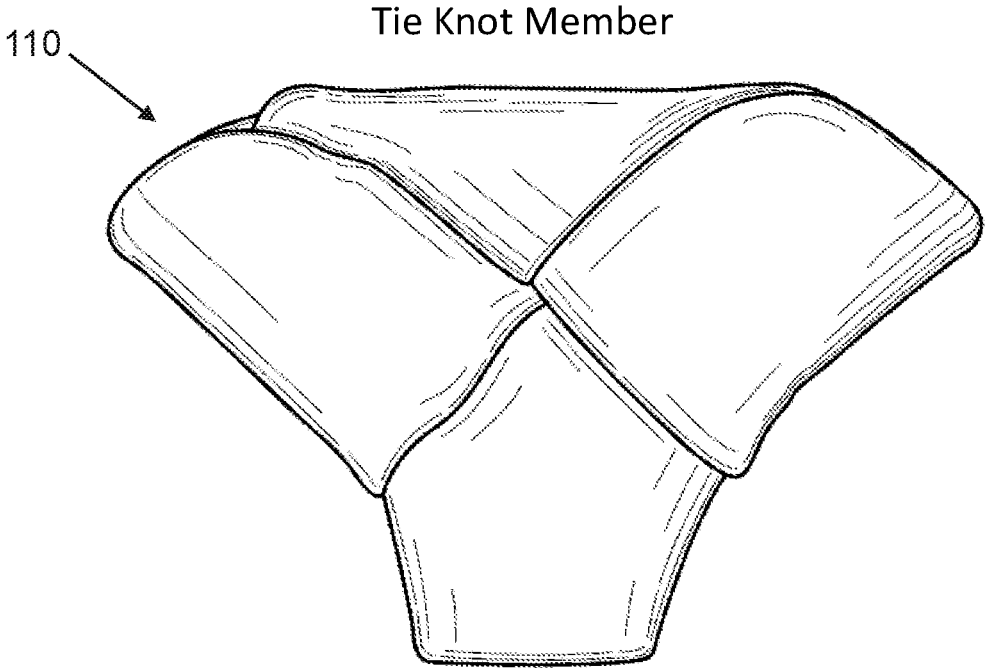
FIG. 2C is a rear view of a tie knot member, according to an embodiment of the invention.
Figure 2D:
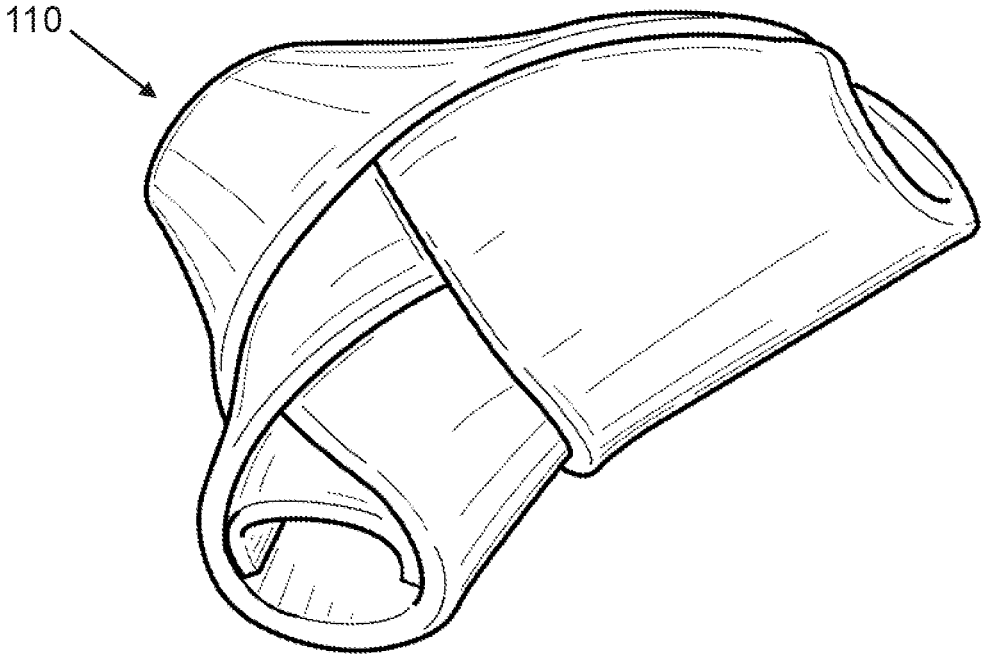
FIG. 2D is a front perspective view of a tie knot member, according to an embodiment of the invention.

In the following, we describe the structure of an embodiment of a tie knot system 100 with reference to FIG. 1, in such manner that like reference numerals refer to like components throughout; a convention that we shall employ for the remainder of this specification.

In an embodiment, as shown in FIGS. 1, 2A, 2B, 2C, 2D, 3A, 3B, and 3C a tie knot system 100 can include:

a) a necktie 150; and b) a tie knot member 110;

wherein the tie knot member 110 can be configured with a first interior 211 and first and second upper apertures 112 114 and a lower aperture 116, whereby the tie knot member 110 is configured to receive the necktie 150, such that a narrow tail 152 of the necktie 150 protrudes through 262 the lower aperture 116 and out of the first upper aperture 112 and loops back 264 via the second upper aperture 114 and out of the lower aperture 116.

In a related embodiment, a necktie 150 can be configured with a narrow tail end 612 that is shorter than conventional necktie members, for example such that a length 622 of the narrow tail end 612 is 2-4 inches shorter than a length 624 of the wide display end 614.

In a further related embodiment, a length of the narrow tail end 612 can be 20-28 inches.

In another further related embodiment, a length 622 of the narrow tail end 612 can be in a range of 22-26 inches, and a length 624 of the wide display end 614 can be 24-28 inches; for example, such that a length 622 of the narrow tail end 612 is about 24 inches, and a length 624 of the wide display end 614 is about 26 inches for a total length 636 of about 50 inches; i.e. substantially shorter than conventional ties, which generally have a length of 58-62 inches.

In a related embodiment, as shown in FIGS. 2B, 3A, 3B, and 3C, the tie knot system 100 can further include:

an inner knot member 220, which is positioned in the first interior 211 of the tie knot member 110;

wherein the inner knot member 220 can be configured with a second interior 311, first and second upper openings 222 224, and a lower opening 226, such that the openings 222 224 226 provide access to the second interior 311; whereby the inner knot member 220 is configured to receive the necktie 150, such that a narrow tail 152 of the necktie 150 protrudes through 262 the lower opening 226 and out of the first upper opening 222 and loops back 264 via the second upper opening 224 and out of the lower opening 226.

Figure 4A:
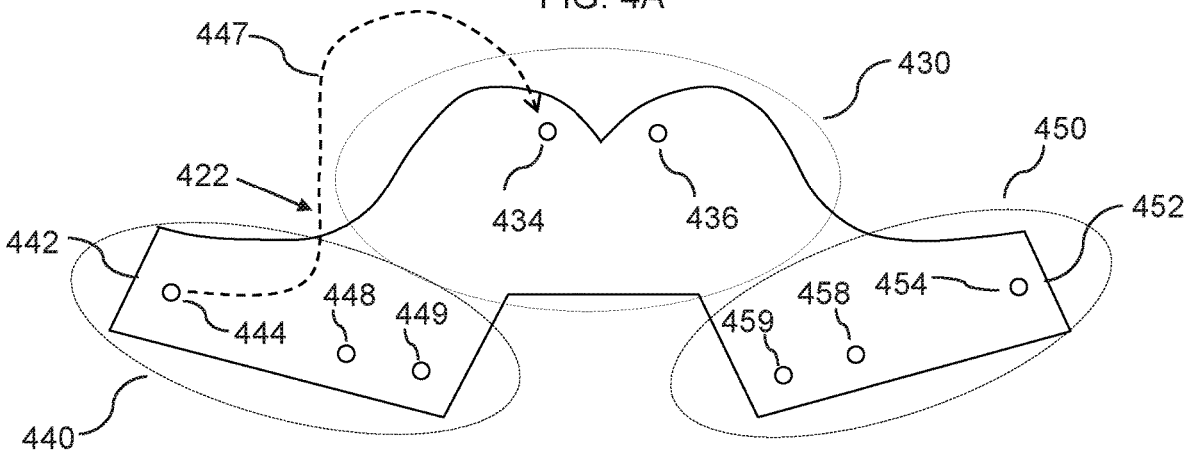
FIG. 4A is a front view of an inner knot member sheet prior to assembly, according to an embodiment of the invention.
Figure 4B:
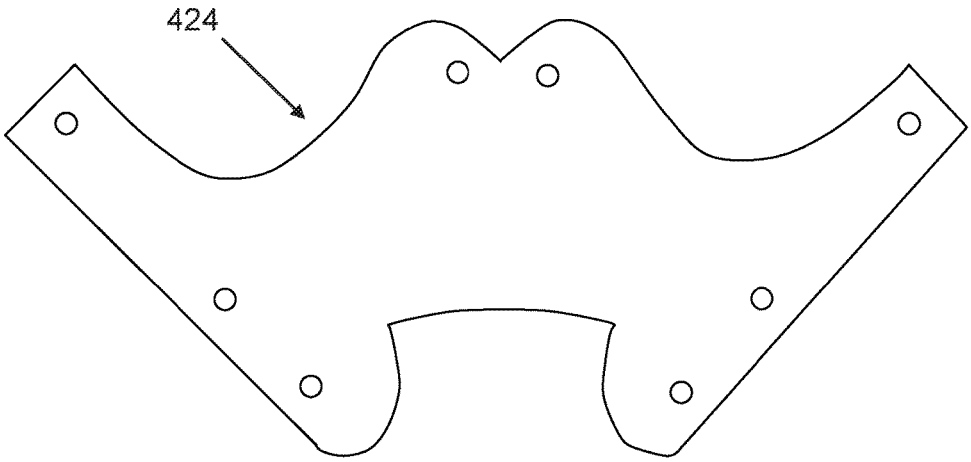
FIG. 4B is a front view of an inner knot member sheet prior to assembly, according to an embodiment of the invention.
Figure 5A:
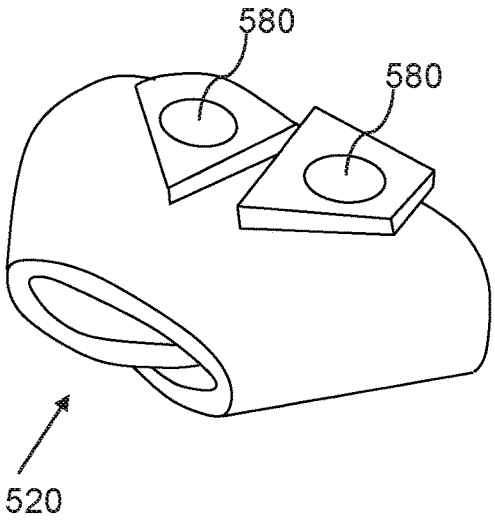
FIG. 5A is a rear perspective view of an inner knot member, according to an embodiment of the invention.
Figure 5B:
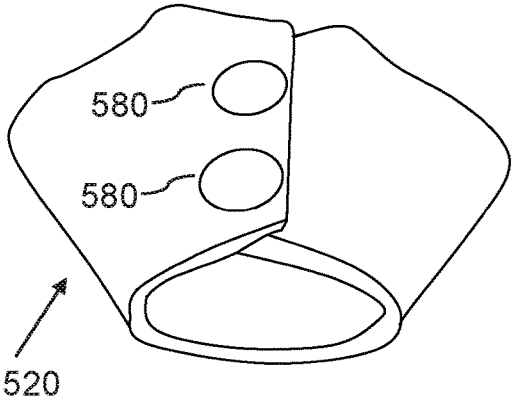
FIG. 5B is a front perspective view of an inner knot member, according to an embodiment of the invention.
Figure 5C:
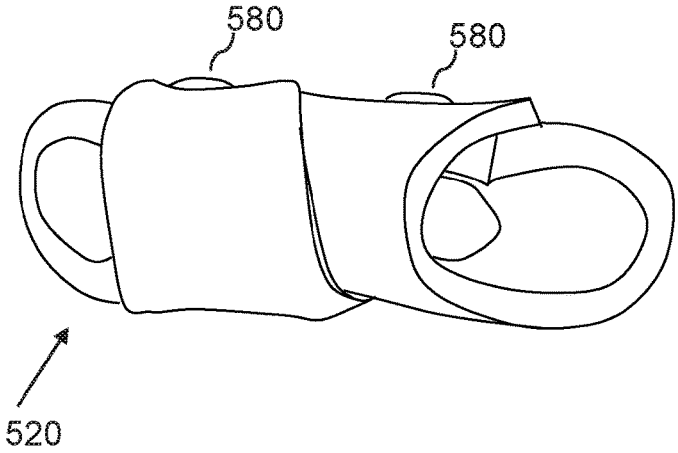
FIG. 5C is a top perspective view of an inner knot member, according to an embodiment of the invention.
Figure 6:
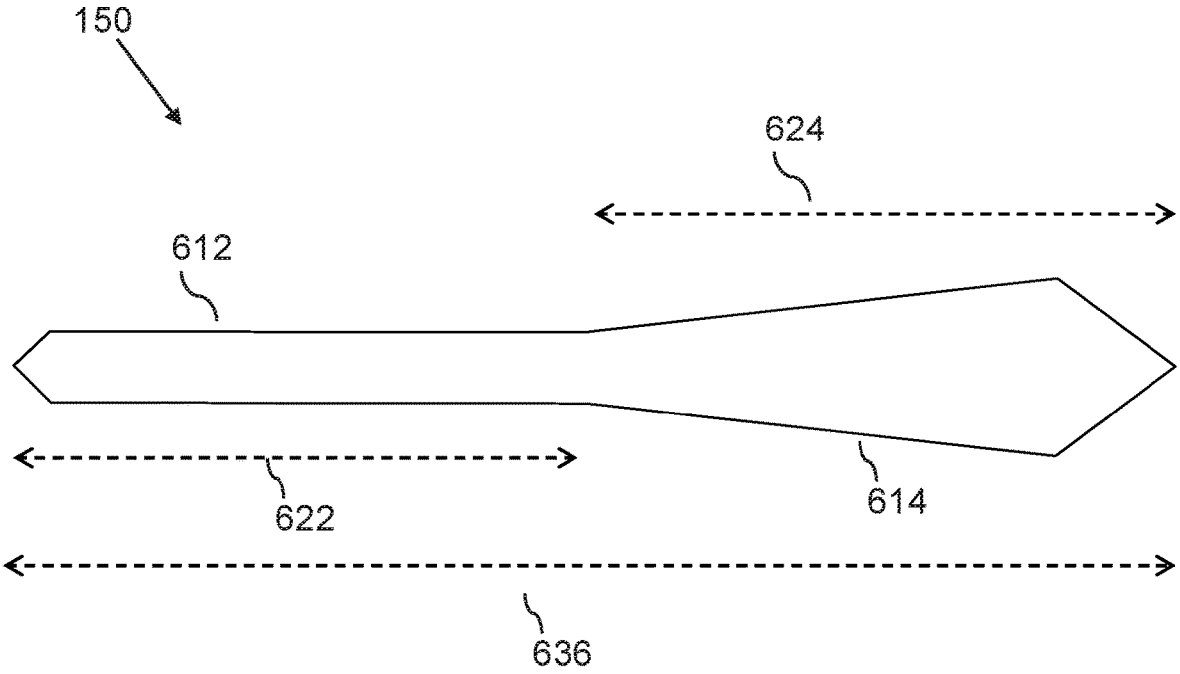
FIG. 6 is a front view of a tie member, according to an embodiment of the invention.

In a related embodiment, as shown in FIGS. 4A, 4B, 5A, 5B, and 5C, an inner knot member 520 can be folded and assembled/connected from a tie knot sheet 422. FIGS. 4A and 4B show different shapes of the tie knot sheet 422 424, which produce inner knot members 520 of different shape.

In a related embodiment, the tie knot sheet 422 424 can be configured with a left-right symmetrical shape, such that the tie knot sheet 422 424 can include:

a) a bridge portion 430, wherein an upper edge 432 can be shaped as a double-arch; and b) left/first and right/second elongated portions 440 450, wherein lower portions of the left/first and right/second elongated portions 440 450 are connected via the bridge portion 430, such that the left/first and right/second elongated portions 440 450 can be upward and outward pointing;

wherein the elongated portions 440 450 are curved inward 447, such that outer ends 442 452 are connected to a rear side of the upper part of the bridge portion 430, for example on respective right and left arch portions of the double-arch; for example such that right and left end rivet apertures/points 444 454 of the outer ends 442 452 are positioned on respective right and left bridge rivet apertures/points 434 436 and connected with rivets 580; and wherein lower inner ends of the elongated portions 440 450 are folded in to connect, for example such that left inner end rivet apertures/points 448 449 on an inner end of the left elongated portion 440 are positioned on respective right inner end rivet apertures/points 458 459 on an inner end of the right elongated portion 450 and connected with rivets.

In a related embodiment, the inner knot member 220 and the tie knot sheet 422 424 can be made of a resilient material, such as rubber or leather, such that when the inner knot member 220 is deformed by external pressure it will bounce back to its original shape once the pressure is removed.

Figure 3A:
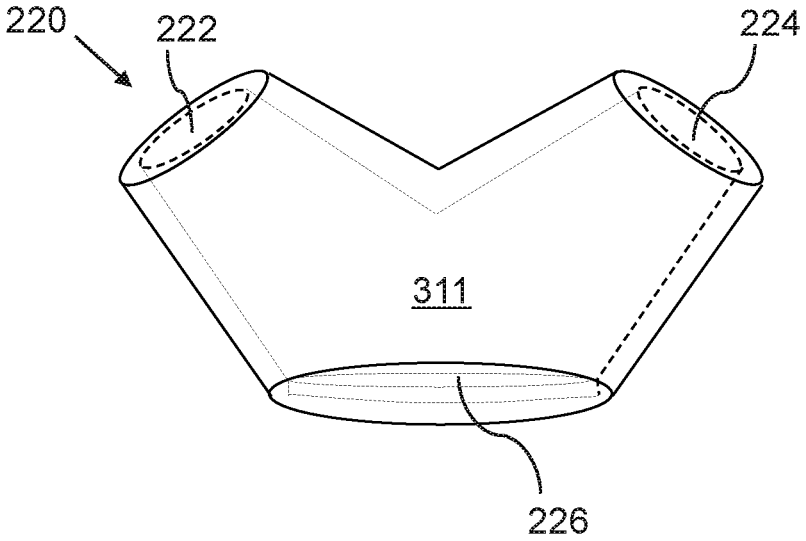
FIG. 3A is a front view of an inner knot member, according to an embodiment of the invention.
Figure 3B:
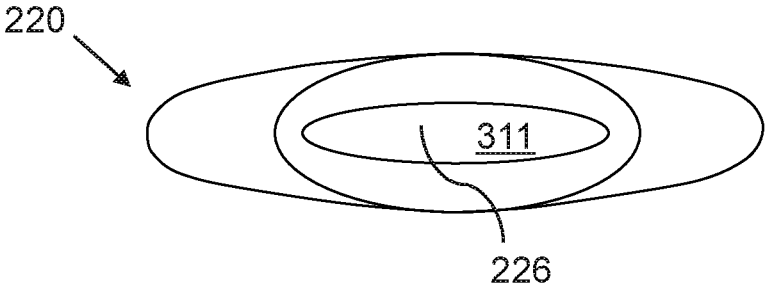
FIG. 3B is a bottom view of an inner knot member, according to an embodiment of the invention.
Figure 3C:
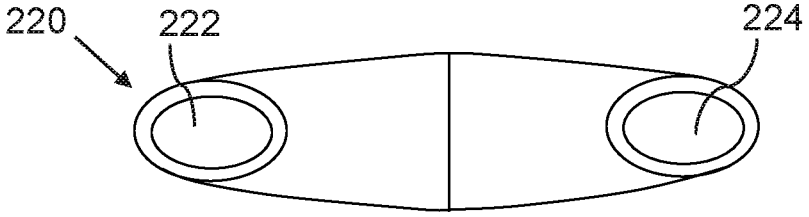
FIG. 3C is a top view of an inner knot member, according to an embodiment of the invention.
Figure 3D:
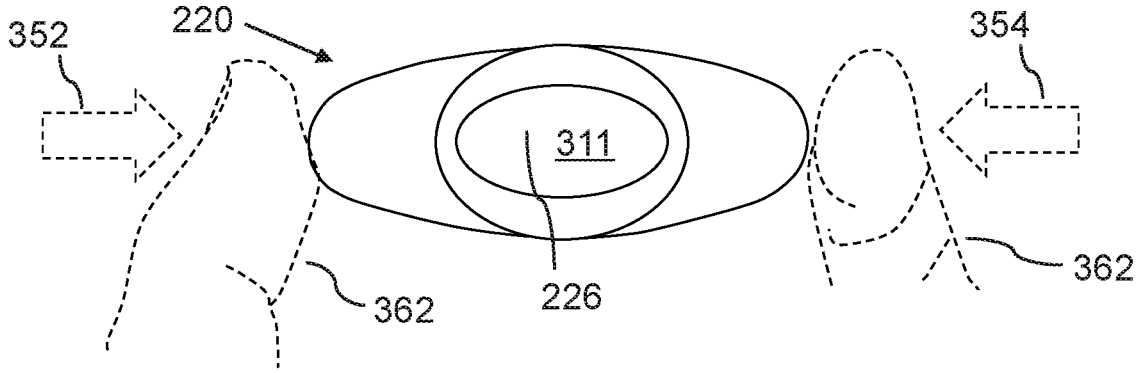
FIG. 3D is a bottom view of an inner knot member in a deformed state, according to an embodiment of the invention.
Figure 3E:
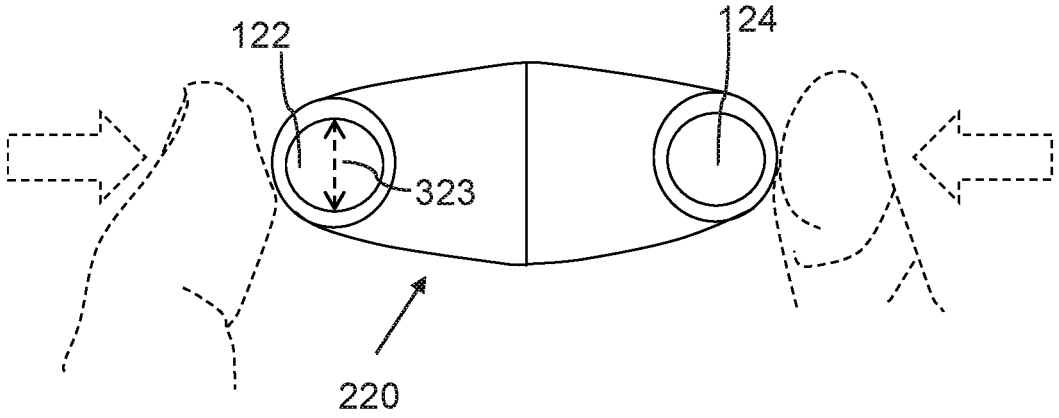
FIG. 3E is a top view of an inner knot member in a deformed state, according to an embodiment of the invention.

In a further related embodiment, when the inner knot member 220 420 is made of a resilient material, as shown in FIGS. 3B and 3C, the first and second upper openings 222 224 and the lower opening 226 of the inner knot member 220 can be configured to be elongated in a right-to-left direction, such as ellipse-shaped with a long axis in the right-to-left direction, when in a resting configuration (with no external pressure applied), such that the necktie 150 is held place by a friction hold of the first and second upper openings 222 224 and the lower opening 226, when heights 323 of the openings 222 224 226 are in a minimal state; such that when external inward pressure 352 354 is applied, for example by fingers 362 364, as shown in FIGS. 3D and 3E, the inner knot member 220 is deformed, such that the first and second upper openings 122 124 and the lower opening 126 become more circular, i.e. less elongated in right-to-left direction, such that heights 323 of the openings 122 124 126 is increased, whereby it is easier to insert the necktie 150 through the openings 122 124 126.

Figure 7A:
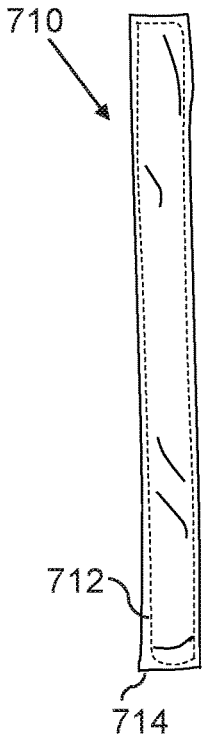
FIG. 7A is a front view of an elongated piece for manufacturing a tie knot member, according to an embodiment of the invention.

In a related embodiment, the tie knot member 110 can be made from an elongated piece 710, as shown in FIG. 7A, which can be a cloth piece 710 comprising an internal material piece 712 and an outer lining 714, which elongated piece 710 can be folded around the inner knot member 220, such that the elongated piece 710 forms a diagonally overlapping pattern on a front of the tie knot member 110.

Figure 7B:
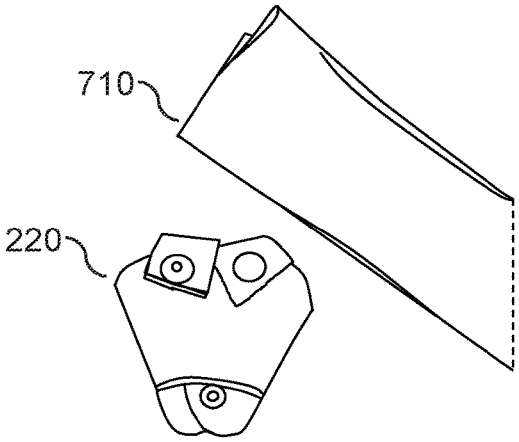
FIG. 7B is a front view of an elongated piece and an inner knot member prior to manufacturing a tie knot member, according to an embodiment of the invention.
Figure 8A:
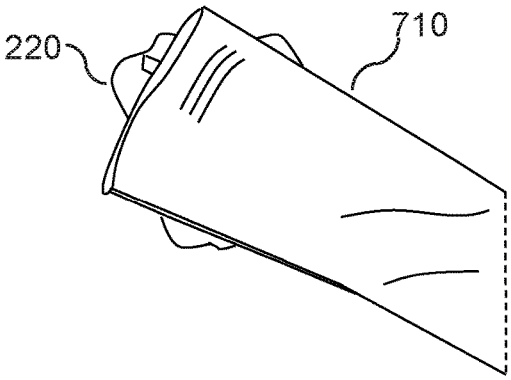
FIG. 8A shows a first step of manufacturing a tie knot member, in a front view of the tie knot member during manufacturing, according to an embodiment of the invention.
Figure 8B:
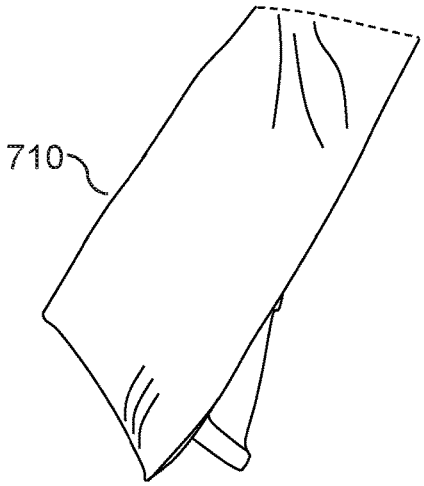
FIG. 8B shows a second step of manufacturing a tie knot member, in a front view of the tie knot member during manufacturing, according to an embodiment of the invention.
Figure 8C:
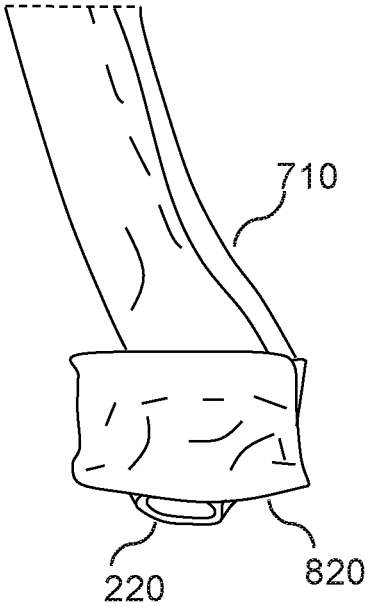
FIG. 8C shows a third step of manufacturing a tie knot member, in a front view of the tie knot member during manufacturing, according to an embodiment of the invention.
Figure 8D:
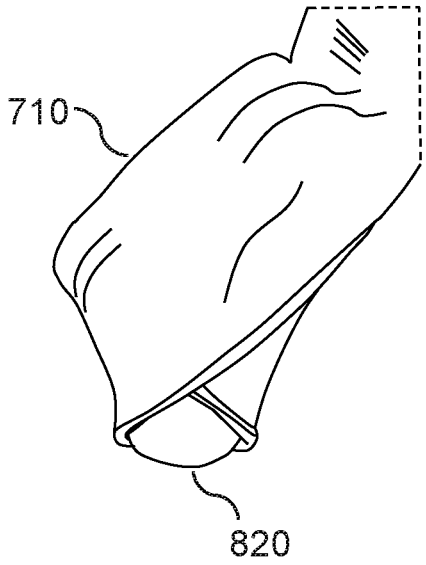
FIG. 8D shows a fourth step of manufacturing a tie knot member, in a front view of the tie knot member during manufacturing, according to an embodiment of the invention.
Figure 8E:
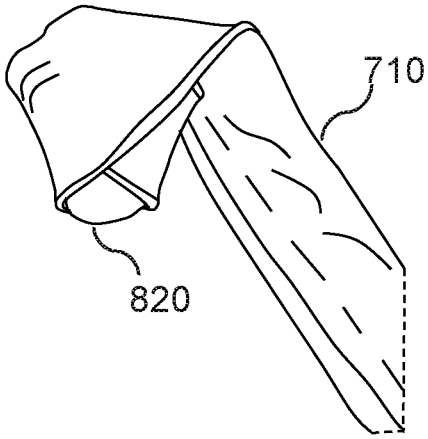
FIG. 8E shows a fifth step of manufacturing a tie knot member, in a front view of the tie knot member during manufacturing, according to an embodiment of the invention.
Figure 8F:
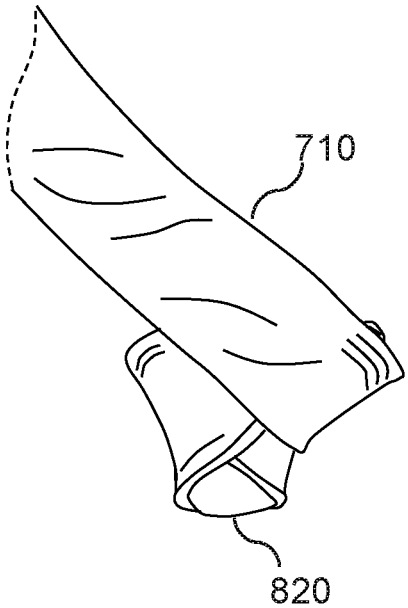
FIG. 8F shows a sixth step of manufacturing a tie knot member, in a front view of the tie knot member during manufacturing, according to an embodiment of the invention.
Figure 8G:
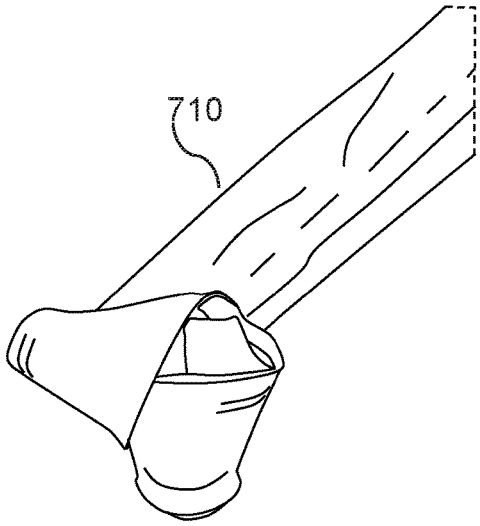
FIG. 8G shows the sixth step of manufacturing a tie knot member, in a rear view of the tie knot member during manufacturing, according to an embodiment of the invention.
Figure 8H:
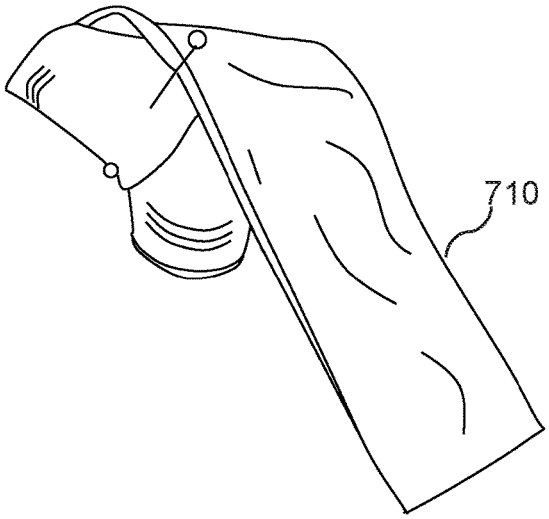
FIG. 8H shows a seventh step of manufacturing a tie knot member, in a rear view of the tie knot member during manufacturing, according to an embodiment of the invention.
Figure 8I:
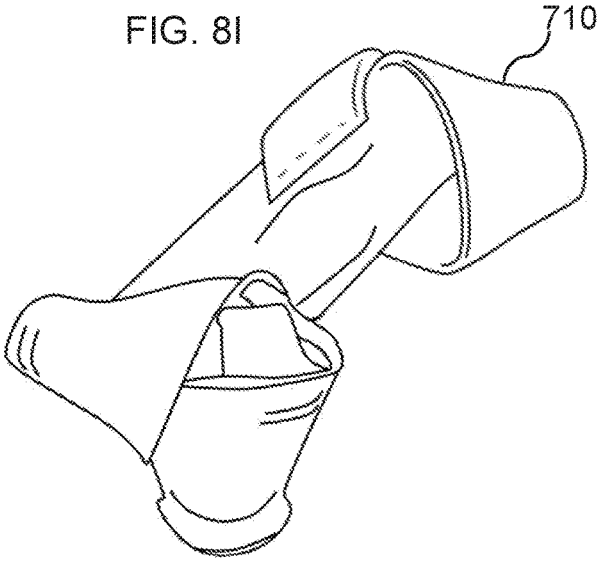
FIG. 8I shows an eighth step of manufacturing a tie knot member, in a rear view of the tie knot member, according to an embodiment of the invention.
Figure 8J:
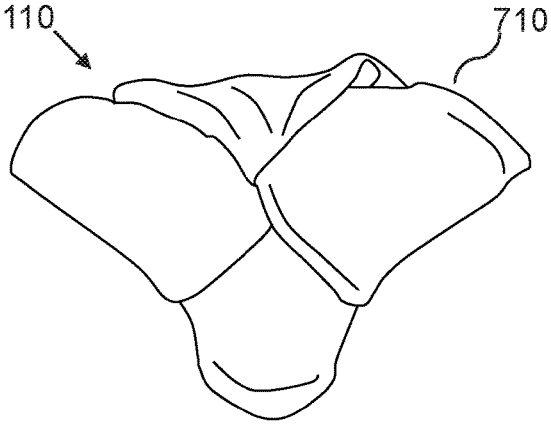
FIG. 8J shows a rear view the tie knot member, after final step of manufacturing, according to an embodiment of the invention.
Figure 8K:
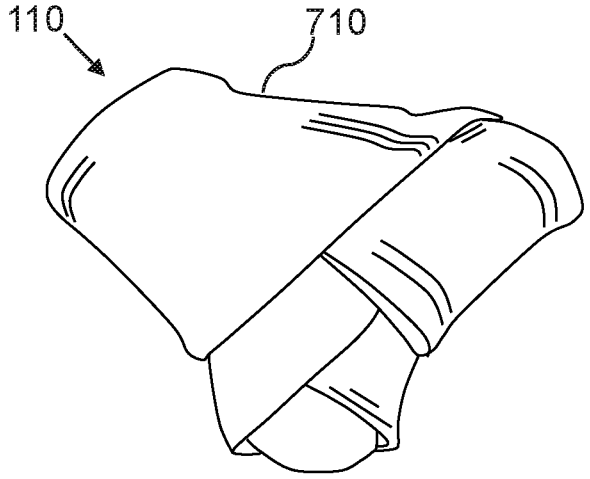
FIG. 8K shows a front view of the tie knot member, after final step of manufacturing, according to an embodiment of the invention.

In a further related embodiment, the tie knot member 110 comprising an inner knot member 220, which is positioned in the interior of the tie knot member 110, can be manufactured by a manufacturing process comprising:

a) as shown in FIGS. 7B and 8A, positioning a first end of the elongated piece 710 on a front of the inner knot member 220, such that a first remaining part of the elongated piece 710 is oriented downward and outward, as shown in FIGS. 7B and 8A;

b) as shown in FIG. 8B, folding the elongated piece 710 around a rear of the inner knot member 220, such that the elongated piece 710 folds around to a front of the inner knot member 220, such that a second remaining part of the elongated piece 710 is oriented upward and rightward;

c) as shown in FIG. 8C, positioning a front cover piece 820 on a front of the inner knot member 220;

d) as shown in FIG. 8D, folding the elongated piece 710 over the front cover piece 820;

e) as shown in FIG. 8E, folding the elongated piece 710 down, to begin forming a right side of the tie knot member 110, such that a third remaining part of the elongated piece 710 is oriented downward and leftward on a rear of the tie knot member 110.

f) as shown in FIG. 8F, folding the elongated piece 710 up, as shown in FIG. 8F, to form a right side of the tie knot member 110 including a second/right upper aperture 114, such that a third remaining part of the elongated piece 710 is oriented upward and leftward on a front of the tie knot member 110. FIG. 8G shows a rear side view of FIG. 8F;

g) as shown in FIG. 8H, from the rear side view, folding the elongated piece 710 down, to begin forming a left side (from the front view) of the tie knot member 110;

h) as shown in FIG. 8I, from the rear side view, folding the elongated piece 710 up around the front, to complete the left side of the tie knot member 110, and then down to be tucked under the elongated piece 710, to product the final state of the tie knot member 110, as shown in FIG. 8J. FIG. 8K shows a front side view of FIG. 8J, in the final state of the tie knot member 110 with a second end of the elongated piece 710 tucked in. Pins can be used during the process of manufacturing to secure the elongated piece 710 in place.

Here has thus been described a multitude of embodiments of the tie knot system 100, the tie knot member 110, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A tie knot system, comprising:

a) a necktie;

b) a tie knot member; and c) an inner knot member, which is positioned in a first interior of the tie knot member;

wherein the tie knot member is configured with the first interior, first and second upper apertures, and a lower aperture, such that the first and second upper apertures and the lower aperture provide access to the first interior;

such that a narrow tail of the necktie protrudes through the lower aperture and out of the first upper aperture and loops back via the second upper aperture and out of the lower aperture;

wherein the inner knot member is configured with a second interior, first and second upper openings and a lower opening, such that the first and second upper openings and the lower opening provide access to the second interior;

wherein the first interior and the second interior are distinct and separate interiors;

such that the narrow tail of the necktie protrudes through the lower opening and out of the first upper opening and loops back via the second upper opening and out of the lower opening.

2. The tie knot system of claim 1, wherein the narrow tail of the necktie is 2-4 inches shorter than a wide display end of the necktie.

3. The tie knot system of claim 1, wherein a length of the narrow tail of the necktie is in a range of 20-28 inches.

4. The tie knot system of claim 1, wherein a length of the narrow tail of the necktie is in a range of 22-26 inches, and a length of a wide display end of the necktie is in a range of 24-28 inches.

5. The tie knot system of claim 1, wherein the inner knot member is made of a resilient material.

6. The tie knot system of claim 5, wherein the resilient material is leather.

7. The tie knot system of claim 5, wherein the first and second upper openings and the lower opening of the inner knot member are configured to be elongated in a right-to-left direction, such that when external inward pressure is applied, the inner knot member is deformed, such that the first and second upper openings and the lower opening become less elongated in the right-to-left direction, such that heights of the first and second upper openings and the lower opening of the inner knot member are increased, whereby it is easier to insert the necktie through the first and second upper openings and the lower opening of the inner knot member.

8. The tie knot system of claim 1, further comprising a tie knot sheet, wherein the inner knot member is folded and assembled from the tie knot sheet.

9. The tie knot system of claim 8, wherein the tie knot sheet is configured with a left-right symmetrical shape, the tie knot sheet comprising:

a) a bridge portion; and b) left and right elongated portions, wherein lower portions of the left and right elongated portions are connected via the bridge portion, such that the left and right elongated portions are upward and outward pointing;

wherein the left and right elongated portions are curved inward, such that outer ends of the left and right elongated portions are connected to a rear side of an upper part of the bridge portion; and wherein lower inner ends of the elongated portions are folded in to connect.

10. The tie knot system of claim 9, wherein an upper edge of the bridge portion is shaped as a double-arch.

11. A tie knot system, comprising:

a tie knot member; and an inner knot member, which is positioned in a first interior of the tie knot member;

wherein the tie knot member is configured with the first interior and first and second upper apertures and a lower aperture, such that the first and second upper apertures and the lower aperture provide access to the first interior; such that the tie knot member is configured to receive a necktie, such that a narrow tail of the necktie protrudes through the lower aperture and out of the first upper aperture and loops back via the second upper aperture and out of the lower aperture;

wherein the inner knot member is configured with a second interior, first and second upper openings and a lower opening, such that the first and second upper openings and the lower opening provide access to the second interior;

wherein the first interior and the second interior are distinct and separate interiors;

such that the narrow tail of the necktie protrudes through the lower opening and out of the first upper opening and loops back via the second upper opening and out of the lower opening.

12. The tie knot system of claim 11, wherein the inner knot member is made of a resilient material.

13. The tie knot system of claim 12, wherein the first and second upper openings and the lower opening of the inner knot member are configured to be elongated in a right-to-left direction, such that when external inward pressure is applied, the inner knot member is deformed, such that the first and second upper openings and the lower opening become less elongated in the right-to-left direction, such that heights of the first and second upper openings and the lower opening of the inner knot member are increased, whereby it is easier to insert the necktie through the first and second upper openings and the lower opening of the inner knot member.

14. The tie knot system of claim 11, further comprising a tie knot sheet, wherein the inner knot member is folded and assembled from the tie knot sheet.

15. The tie knot system of claim 14, wherein the tie knot sheet is configured with a left-right symmetrical shape, the tie knot sheet comprising:

a) a bridge portion; and b) left and right elongated portions, wherein lower portions of the left and right elongated portions are connected via the bridge portion, such that the left and right elongated portions are upward and outward pointing;

wherein the left and right elongated portions are curved inward, such that outer ends of the left and right elongated portions are connected to a rear side of an upper part of the bridge portion; and wherein lower inner ends of the elongated portions are folded in to connect.

16. The tie knot system of claim 15, wherein an upper edge of the bridge portion is shaped as a double-arch.

17. The tie knot system of claim 11, further comprising an elongated piece, wherein the tie knot member is made from the elongated piece, which is folded around the inner knot member, such that the elongated piece forms a diagonally overlapping pattern on a front of the tie knot member.

18. The tie knot system of claim 11, further comprising the necktie.

* * * * *